US005187812A

United States Patent [19]

Neuhalfen

[11] Patent Number: 5,187,812

[45] Date of Patent: * Feb. 23, 1993

[54] FOOTBALL SHOULDER PAD WITH OUTER PADS

[75] Inventor: Mark Neuhalfen, Hillside, Ill.

[73] Assignee: Wilson Sporting Goods Co., River Grove, Ill.

[ * ] Notice: The portion of the term of this patent subsequent to Oct. 29, 2008 has been disclaimed.

[21] Appl. No.: 781,866

[22] Filed: Oct. 24, 1991

Related U.S. Application Data

[63] Continuation-in-part of Ser. No. 502,797, Apr. 2, 1990, Pat. No. 5,060,313.

[51] Int. Cl.[5] ..... A41D 13/00

[52] U.S. Cl. ..... 2/2; 2/44; 2/45; 2/267; 2/268

[58] Field of Search ..... 2/2, 44, 45, 267, 268

[56] References Cited

U.S. PATENT DOCUMENTS

| | | | |
|---|---|---|---|
| 1,094,865 | 4/1914 | Pierce | 2/2 |
| 1,600,410 | 11/1924 | Hartman | 2/267 |
| 2,761,143 | 9/1956 | Martin et al. | 2/2 |
| 3,044,075 | 7/1962 | Rawlings | 2/267 |
| 3,146,461 | 9/1964 | Kavanagh | 2/2 |
| 3,500,472 | 3/1970 | Castellani | 2/2 |
| 4,272,847 | 6/1981 | Buhler | 2/2 |
| 4,317,237 | 3/1982 | Porte | 2/2 |
| 4,322,858 | 4/1982 | Douglas | 2/2 |
| 4,554,681 | 11/1985 | Kirkland | 2/2 |
| 4,642,814 | 2/1987 | Godfrey | 2/2 |
| 4,642,815 | 2/1987 | Allen | 2/2 |
| 4,698,845 | 10/1987 | Cosby | 2/2 |
| 4,989,265 | 2/1991 | Nipper et al. | 2/2 |
| 5,054,121 | 10/1991 | Mitchell | 2/2 |

*Primary Examiner*—Andrew M. Falik
*Assistant Examiner*—Gloria Hale

[57] ABSTRACT

A football shoulder pad includes a pair of relatively rigid arch portions which extend over the shoulders of a wearer and a pair of resilient pads which are removably secured to the rear surfaces of the arch portions. The pads reduce the tendency of a football to bounce off of the arch portions.

12 Claims, 2 Drawing Sheets

FOOTBALL SHOULDER PAD WITH OUTER PADS

RELATED APPLICATION

This is a continuation-in-part application of my copending application Ser. No. 502,797, filed Apr. 2, 1990, now U.S. Pat. No. 5,060,313 issued on Oct. 29, 1991.

BACKGROUND

This invention relates to football shoulder pads, and, more particularly, to a football shoulder pad which is provided with outer pads to reduce the tendency of a football to bounce off of the shoulder pad.

Football shoulder pads conventionally include a pair of relatively rigid U-shaped arch portions which extend over the shoulders of the wearer. The arch portions are molded from plastic or similar material, and padding and suspension straps are generally attached to the inside surfaces of the arch portions for cushioning impacts.

The outside surfaces of the arch portions generally remain uncovered. As a result, a football or other object which contacts the hard outer surfaces will tend to bounce away. That is a disadvantage to pass receivers, kick returners, and other players who must catch the football. It is not uncommon for a pass receiver or a kick returner to attempt to catch a ball, only to have the ball hit one of the hard arch portions and bounce away from the player.

SUMMARY OF THE INVENTION

My prior application Ser. No. 502,797 describes outer pads which are removably attached to the front surfaces of the arch portions. This invention provides outer pads which are removably attached to the rear surfaces of the arch portions. Each pad includes a strap which is wrapped around one of the arch portions and is removably secured to the pad by hook and loop fasteners. The pads not only reduce the tendency of a ball to bounce away from the shoulder pads but also provide protective cushions for the outer surfaces of the arch portions.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
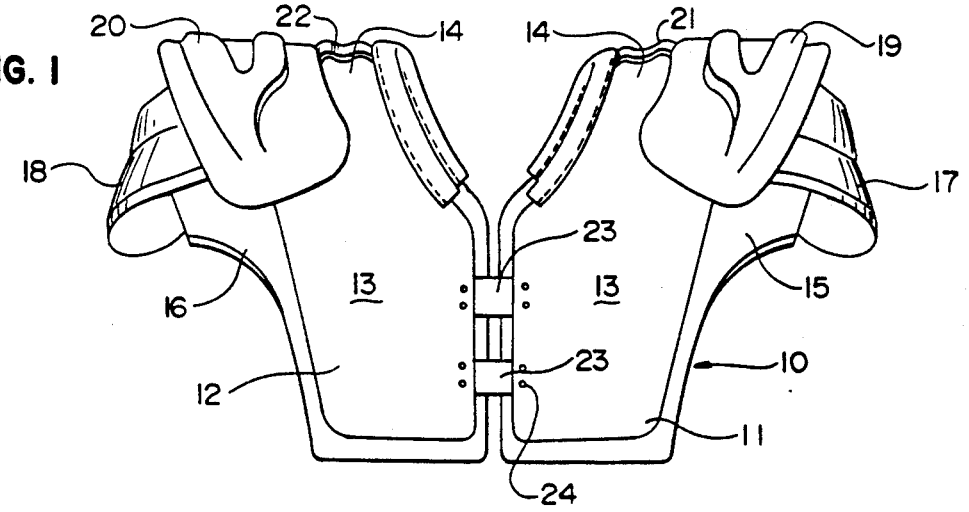
FIG. 1 is a rear elevational view of a conventional prior art shoulder pad.

FIG. 1 is a rear view of a conventional prior art shoulder pad 10. The shoulder pad includes a pair of U-shaped arch portions 11 and 12 which are molded from relatively rigid plastic. Each of the arch portions includes a rear portion 13, a top portion 14, and a front portion (not shown).

U-shaped inner pads 15 and 16 are attached to the inside surfaces of the arch portions, and suspension straps or cantilever straps may also be attached to the inside surfaces to prevent the top portions of the arch portions from being forced against the shoulders of the wearer. A pair of cap pads 17 and 18 are hingedly attached to the arch portions by straps, and a pair of plastic epaulets 19 and 20 overlie the caps and are attached to the arch portions by straps 21 and 22. The front portions of the arch portions are laced together by conventional lacing, and the rear portions are hingedly connected by a pair of flexible straps 23 which are connected to the arch portions by rivets 24.

In the particular shoulder pad illustrated, the rear arch portions 11 and 12 terminate above the bottom edge of the inner pads 15 and 16. It will be understood, however, that the rear arch portions 11 and 12 can extend downwardly to cover more of the inner pads, or the inner pads can be shorter.

The shoulder pad heretofore described is conventional and well known in the industry and a more detailed description thereof is unnecessary. The rear portions of the arch portions extend over the shoulders and a portion of the chest of the wearer and provide protection against impacts during play.

Figure 2:
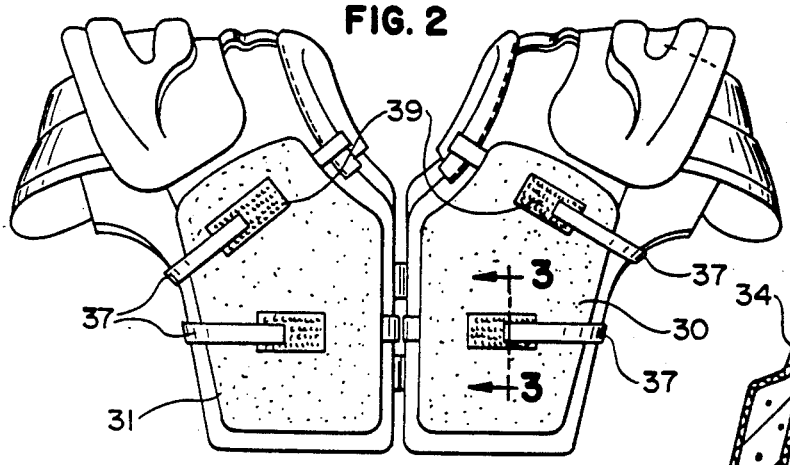
FIG. 2 is a rear elevational view of a shoulder pad equipped with removable outer pads on the arch portions.
Figure 3:
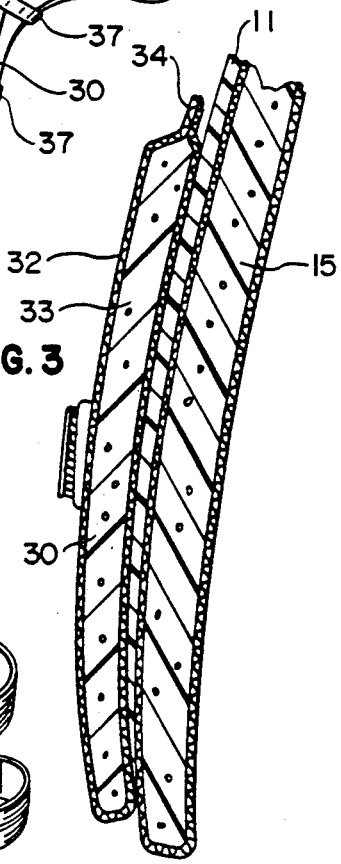
FIG. 3 is an enlarged fragmentary sectional view taken along the line 3—3 of FIG. 2.
Figure 4:
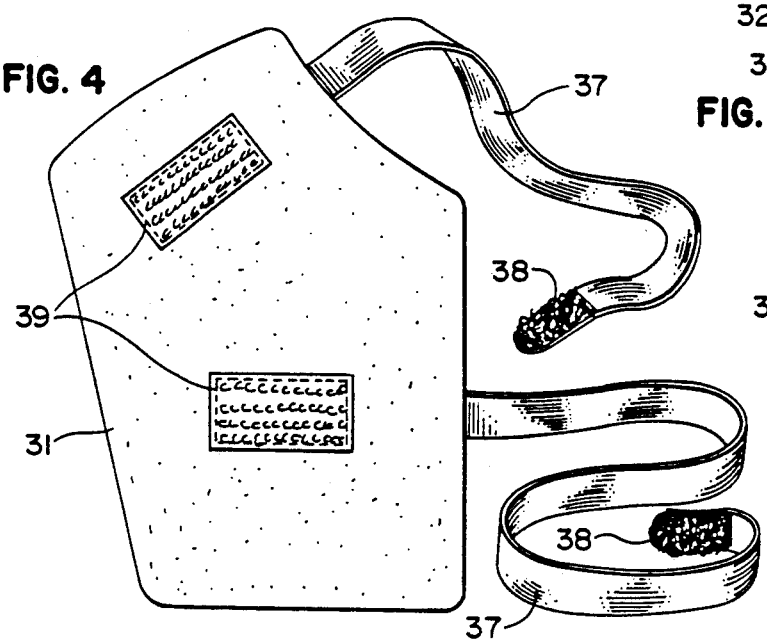
FIG. 4 is a front elevational view of one of the outer pads.

FIG. 2 illustrates the same shoulder pad 10, but a pair of outer pads 30 and 31 are removably attached to the rear surfaces of the two arch portions 11 and 12. Referring to FIGS. 3 and 4, each of the pads includes an outer casing or shell 32 and a cushion 33. The casing 32 may be formed from a sheet of fabric, for example nylon, which is folded around the cushion and secured by stitching 34. The cushion can be formed from any satisfactory compressible and resilient material, for example polyurethane foam.

The pad is removably attached to the arch portion by a pair of straps 37 which are stitched to one side of the casing. A hook and loop fastener pad 38 of the type which is sold under the trademark Velcro is attached to the free end of each strap. Complementary hook and loop fastener pads 39 are attached to the outside surface of the casing. As illustrated in FIGS. 2 and 3, the straps 37 extend around the arch portion and the inner pad 15 or 16 and are secured by the hook and loop pads.

Each of the outer pads 30 and 31 covers a substantial portion of the rear surface of the arch portions. If a ball hits the shoulder pad, the outer pads will cushion the impact and reduce the tendency of the ball to bounce away. The pads also provide additional protective cushioning for the wearer and for other players who might otherwise contact the rigid arch portions.

Since the outer pads are removable, the pads can be worn or omitted depending upon the individual preferences of the players. It is not necessary to alter the shoulder pad in order to accommodate the outer pads. Some players might prefer wearing only one pad, on either the right or left arch portion. Also, the size and shape of the pad can be varied to suit the player.

If desired, other outer pads can be attached to the front portions of the arch portions in order to provide additional protection. Further, other means for removably attaching the outer pads to the arch portions can be used. For example, the outer pads can be attached by snaps or hook and loop fastener pads which are attached to the outer pads and to the arch portions.

Figure 5:
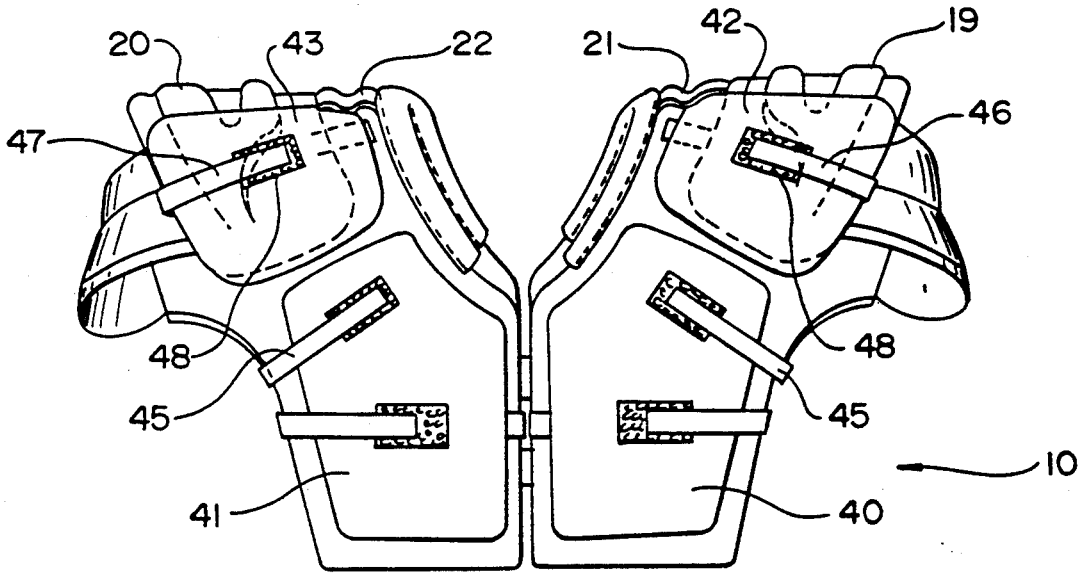
FIG. 5 is a rear elevational view of a shoulder pad equipped with another embodiment of removable outer pads.

FIG. 5 illustrates a shoulder pad 10 which includes a pair of outer pads 40 and 41 which are removably attached to the rear surfaces of the two arch portions 11 and 12 and a pair of outer pads 42 and 43 which are removably attached to the epaulets 19 and 20. The pads 40 and 41 are similar to the pads 30 and 31 and are attached to the arch portions by straps 45 which are similar to the straps 37. The pads 42 and 43 are similarly attached to the epaulets 19 and 20 by straps 46 and 47. Each of the straps 46 and 47 is secured to one side of the casing for the pad and extends around the back of the epaulet pad and is secured to a hook and loop fastener pad 48 on the outer surface of the pad. Since the pads 42 and 43 are attached to the epaulets, the pads move with the epaulets as the epaulets move about their hinge connections 21 and 22.

Figure 6:
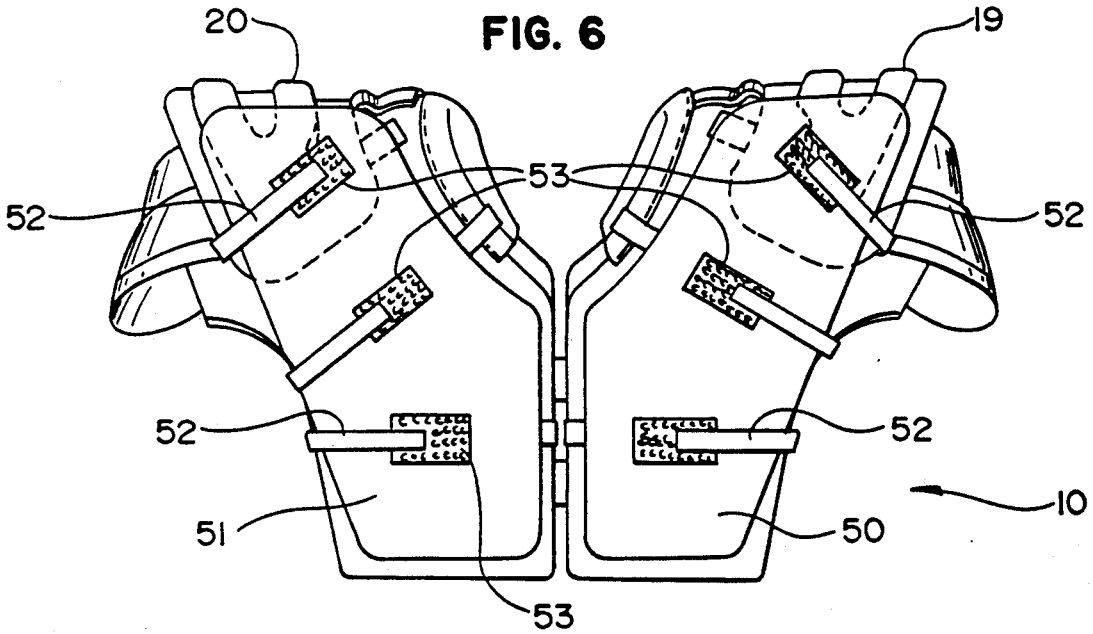
FIG. 6 is a rear elevational view of a shoulder pad equipped with still another embodiment of removable outer pads.

FIG. 6 illustrates a shoulder pad 10 which has two large outer pads 50 and 51 secured to the rear surfaces of the two arch portions 11 and 12. The pads 50 and 51 are similar to the pads 30 and 31 except that the pads 50 and 51 are longer and extend from the bottom of the arch portions to the upper portion of the epaulets 19 and 20. The pads 50 and 51 are attached in substantially the same way as the pads 30 and 31. Straps 52 which are similar to straps 37 extend around the arch portions and are secured by hook and loop fastener pads 53.

The pads illustrated in FIGS. 5 and 6 cover substantially the entire rear portion of the shoulder pad and substantially reduce the possibility of a ball rebounding from the shoulder pad.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A football shoulder pad comprising a pair of relatively rigid arch portions, each of the arch portions being generally U-shaped and having a rear portion shaped to extend over a portion of the back of a wearer, and a pair of compressible and resilient outer pads removably attached to the rear portions of the arch portions, each of the outer pads covering at least a portion of the outer surface of one of the arch portions, and means on the outer pads for removably attaching the outer pads to the arch portions.

2. The shoulder pad of claim 1 in which the outer pads are removably attached to the arch portions.

3. The shoulder pad of claim 1, each outer pad including a strap which extends around one of the arch portions for removably attaching the outer pad to the arch portion.

4. The shoulder pad of claim 1 including a hook and loop fastener pad on each strap and a complementary hook and loop fastener pad on each outer pad whereby each strap can be secured by the hook and loop fastener pads.

5. The shoulder pad of claim 1 including an epaulet hingedly secured to each of the arch portions, each outer pad covering at least a portion of the outer surface of one of the epaulets.

6. A football shoulder pad comprising a pair of relatively rigid arch portions, each of the arch portions being generally U-shaped and having a rear portion shaped to extend over a portion of the back of a wearer, a pair of compressible and resilient outer pads removably attached to the rear portions of the arch portions, each of the outer pads including an outer shell of sheet material and a cushion enclosed by the shell, and means on the outer pads for removably attaching the outer pads to the arch portions.

7. The shoulder pad of claim 6 including an epaulet hingedly secured to each of the arch portions, and a second pair of compressible and resilient outer pads removably attached to the epaulets, and means on the second outer pads for removably attaching the second outer pads to the epaulets.

8. The shoulder pad of claim 6, said attaching means comprising a strap on each of the outer pads which extends around the associated arch portion.

9. The shoulder pad of claim 8 including a hook and loop fastener pad on each strap and a complementary hook and loop fastener pad on each outer pad whereby each strap can be secured by the hook and loop fastener pads.

10. A football shoulder pad comprising a pair of relatively rigid arch portions, each of the arch portions being generally U-shaped and having a rear portion shaped to extend over a portion of the back of a wearer, an epaulet hingedly secured to each of the arch portions, and a compressible and resilient outer pad covering at least a portion of the outer surface of one of the epaulets.

11. A football shoulder pad comprising a pair of relatively rigid arch portions, each of the arch portions being generally U-shaped and having a rear portion shaped to extend over a portion of the back of a wearer, an epaulet hingedly secured to each of the arch portions, a pair of compressible and resilient outer pads removably attached to the rear portions of the arch portions, each of the outer pads covering at least a portion of one of the epaulets and including an outer shell of sheet material and a cushion enclosed by the shell, and means on the outer pads for removably attaching the outer pads to the arch portions.

12. The shoulder pad of claim 11 including a second pair of compressible and resilient outer pads removably attached to the epaulets and means on the second outer pads for removably attaching the second outer pads to the epaulets.

* * * * *